US006520664B1

(12) United States Patent
Amrein et al.

(10) Patent No.: US 6,520,664 B1
(45) Date of Patent: Feb. 18, 2003

(54) PIGMENT COATED LAMP AND LUMINAIRE EMITTING COLORED LIGHT

(75) Inventors: Thomas Amrein, Aachen (DE); Joachim Opitz, Aachen (DE); Stefan Gruhlke, Würselen (DE)

(73) Assignee: Koninklijke Philips Electronics N.V., Eidenhoven (NL)

( * ) Notice: Subject to any disclaimer, the term of this patent is extended or adjusted under 35 U.S.C. 154(b) by 0 days.

(21) Appl. No.: 09/638,552

(22) Filed: Aug. 14, 2000

(30) Foreign Application Priority Data

Aug. 14, 1999 (DE) ..... 199 38 700

(51) Int. Cl.[7] ..... F21V 9/00

(52) U.S. Cl. ..... 362/293; 362/255; 313/635; 313/111

(58) Field of Search ..... 362/293, 255; 313/111, 112, 635

(56) References Cited

U.S. PATENT DOCUMENTS 4,215,390 A * 7/1980 Brandt ..... 362/311
4,344,016 A * 8/1982 Hoffman et al. ..... 313/489
5,587,835 A * 12/1996 Shimizu et al. ..... 359/589

* cited by examiner

*Primary Examiner*—Sandra O'Shea
*Assistant Examiner*—Ronald E. DelGizzi
(74) *Attorney, Agent, or Firm*—Frank Keegan; Dicroan Halajian

(57) ABSTRACT

A colored luminaire, in particular a colored signaling light for automobiles, fitted with a lamp and a luminaire cover in which the lamp has a bulb with a coating of a first layer comprising a pigment, which pigment is chosen from the group of perylene pigments, perinone pigments, isoindoline pigments, and thioindigo pigments, is remarkable for a long useful life. It is not attacked by UV radiation, moisture, and spraying salt and is resistant to temperatures of between 250 and 350° C. Colored luminaires with bulb coatings comprising these pigments alone or in combination with further pigments for color correction comply with the color standards for automobile luminaires.

16 Claims, 1 Drawing Sheet

PIGMENT COATED LAMP AND LUMINAIRE EMITTING COLORED LIGHT

BACKGROUND OF THE INVENTION

The invention relates to a colored luminaire, in particular a colored signaling light for automobiles, provided with a lamp and a luminaire cover inside which the lamp has a bulb with a coating of a layer comprising an organic pigment.

Colored luminaires are used in automobiles in various locations, for example for brake lights, indicator lights, and fog lights. In conventional colored luminaires, the bulb of the lamp is made from colorless glass, and the lamp is positioned under a colored, usually red or yellow luminaire cover. A more recent development involves the use of colored lamps for colored luminaires under a colorless or neutrally colored cover. This renders it possible to incorporate signaling lamps of various types as a group of lamps under one and the same luminaire cover.

Luminaires with colored lamps under a colorless or neutrally colored cover have the advantage that they render possible a flexible, optically attractive design for integrated front and rear luminaires. In addition, they are cheaper than luminaires with multiple housings or covers of various colors. These luminaires in addition are safer in traffic because the difference between switched-on and switched-off lights is more clearly noticeable in daylight in the case of luminaires having colored lamps and a colorless or neutrally colored luminaire cover.

In principle, inorganic or organic color pigments may be used for the colored, pigmented bulb coating of colored lamps. The known red and yellow inorganic color pigments are stable in the long term, but they do not have optimum colorimetric values. Bulb coatings with organic color pigments, for example the coatings with red pigments from the group of anthrachinon pigments known from JP-A-60 116958, can indeed be optimized as regards their color co-ordinates, but they tend towards the yellow in time.

As in many other branches of industry, the trend in the case of automobile lamps is towards an ever increasing miniaturization. Efforts are made to reduce the overall dimensions of the lighting units of an automobile and, for example, to integrate the signaling lights into the main lights. The lamps in such lighting units, however, are subjected to higher thermal loads.

SUMMARY OF THE INVENTION

It is an object of the present invention to provide a colored luminaire fitted with a lamp and a luminaire cover in which the lamp has a bulb with a coating of a layer comprising an organic color pigment, which lamp has a long useful life also at elevated ambient temperatures as well as optimized color co-ordinates, and which lamp is suitable for an automobile lighting unit.

According to the invention, this object is achieved by means of a colored luminaire fitted with a lamp and a luminaire cover wherein the lamp has a bulb coating with a first layer comprising a pigment, which pigment is chosen from a group comprising perylene pigments, perinone pigments, isoindoline pigments, and thioindigo pigments.

A luminaire with such a lamp has a long useful life. It is not attacked by UV radiation, moisture, and spray salt and is resistant to temperatures of between 250 and 350° C. Colored luminaires with bulb coatings comprising these pigments alone or in combination with further pigments for color correction comply with the color standards for automobile lights as defined by the E.C.E. for Europe and the S.A.E. for the USA.

In a preferred embodiment, the first pigment-containing layer in addition comprises an iron oxide pigment. An iron oxide pigment in the layer corrects the color value of the organic pigment, for example in the bluish range, for example from yellow to amber, or from orange/red to red. If the lamp is exposed to temperatures above 250° C. for a longer period in the luminaire, it will still have emergency running properties.

It may be preferable that the first pigment-containing layer comprises an iron oxide pigment and a silicon-oxygen compound. Such a layer adheres very well to the glass of the lamp bulb.

In a further preferred embodiment of the invention, a second pigment-containing layer is arranged between the bulb and the first pigment-containing layer, which second layer comprises an iron oxide pigment. If the lamp is exposed to strong and frequent temperature changes and the upper layer should flake off, this embodiment of the luminaire also has emergency running properties.

A transparent layer comprising a silicon-oxygen compound may be arranged between the bulb and the first pigment-containing layer. The mechanical strength of the coating is improved thereby.

It is also possible that the lamp comprises a transparent covering layer comprising a silicon-oxygen compound so as to improve the scratch resistance of the pigment-containing coating.

The invention also relates to a lamp with a bulb having a coating of a layer comprising a pigment chosen from a group which comprises the perylene pigments, perinone pigments, isoindoline pigments, and thioindigo pigments.

The invention will be explained in more detail below with reference to three embodiments.

A colored luminaire according to the invention is provided with a lamp and a luminaire cover inside which the lamp is present and comprises a bulb with a coating of a layer comprising a pigment chosen from the group of the perylene pigments, perinonepigments, isoindoline pigments, and thioindigo pigments.

Depending on the construction of the lamp, the coating may be provided on one or several walls of the lamp bulb, both on the inside and on the outside of the bulb.

The colored luminaire may in addition be fitted with other components, for example means for fastening the lamp in the luminaire, protection means against dust, damage, and moisture, as well as the components necessary for power supply, for example lampholders, cables, ballasts, starters, ignition devices, and connection terminals. A desired light distribution and a dazzle limitation may be achieved by means of optical reflectors, clear or frosted closing plates, rasters of metal or synthetic resin, scattering glass plates, and prismatic reflectors. In an embodiment of the invention, the luminaire contains two or more colored lamps under a joint luminaire cover which is colorless or neutrally colored.

Perylene, perinone, isoindoline, or thioindigo pigments are used for the first pigment-containing layer. The pigments used are polycyclical pigments which have been known for a longer time for coloring textile fibers. The pigments will be denoted hereinafter in accordance with their chemical structures or their color index (C.I.) as published jointly by Society of Dyers and Colourists and the American Association of Textile Chemists and Colorists.

Perinones [CAS 4424-06-0 (trans-perinone), CAS 4216-02-8 (cis-perinone)] are derivatives of 1,4,5,8-naphthalenetetracarbonic acid. Cis- and trans-perinone are obtained as a cis/trans isomer mixture through heating of 1,4,5,8-naphthalenetetracarbonic acid in the form of its monoanhydride, for example in glacial acetic acid at 120° C., with o-phenylenediamine. When the isomers are separated, the trans-perinone is obtained with a pure orange-yellow color and the cis-perinone with a red color.

The perylene pigments are derivatives of 3,4,9,10-perylenetetracarbonic acid. Preferably used may be: the reddish yellow and yellow pigments perylenetetracarbonic-acid bis(methylimide) PR 179 (CAS 5521-31-3), perylenetetracarbonic-acid dianhydride PR 224 (CAS 3049-71-6), bis-dimethylphenylperylimide PR 149, and perylenetetracarbonic-acid diimide) PV 29 (CAS 81-33-4). Generally, the perylene pigments are manufactured from 3,4,9,10-perylenetetracarbonic-acid anhydride through conversion with primary aliphatic amines or substituted anilines, possibly in the presence of a catalyst.

The isoindoline pigments have as their central structural element an isoindoline ring which may be substituted with various substituents via a C=C double bond. Depending on the substituent, the isoindoline pigments are yellow, orange, or red in color. PY 139 (CAS 36888-99-0) with the general formula $C_{16}H_9N_5O_6$ has an orange color and is thermally highly stable. PY 185 (CAS 76199-85-4) has a yellow color and is also thermally very stable.

Of the thioindigo pigments, it is especially the derivatives substituted with chlorine and/or methyl groups which are suitable for the invention. Tetrachloroorthoindigo PR 88 (CAS 14295-43-3) has a reddish violet color which is suitable for adjusting the color of other red pigments.

Preferably, the perylene, perinone, isoindoline, or thioindigo pigments are used in a fine-grain, colloidal form with a particle size 2 nm<d<200 nm so as to obtain transparent layers.

In a preferred embodiment of the invention, the first pigment-containing layer may contain an iron oxide pigment in addition to the perylene, perinone, isoindoline, and thioindigo pigments.

Iron oxide pigments have a wide color spectrum from yellow via orange to red, brown, and black. The natural and synthetic iron oxide pigments used consist of well-defined compounds of known crystal structure. $\alpha$-$Fe_2O_3$ (haematite) with a corundum structure changes its color in dependence on its particle size and crystal shape from bright red to dark violet. $\gamma$-$Fe_2O_3$ (maghemite) with spinel structure is brown. $\alpha$-FeOOH (goethite) with diaspore structure changes its color from bright yellow to brownish yellow as its particle size increases. $\gamma$-FeOOH (lepidocrocite) with boehmite structure changes its color from yellow to orange as the particle size increases. These iron oxides are iron(III) oxides. The reddish violet to black $Fe_3O_4$ (magnetite) with spinel structure is suitable in exceptional cases only. Preferred iron oxide pigments are those which are transparent in fine-grain, colloidal form with a particle size 2 nm<d<15 nm so as to obtain transparent layers.

Transparent yellow iron oxide C. I. PY 42:77492 is $\alpha$-FeOOH (goethite) with diaspore structure. When heated, it changes into the transparent brownish red $\alpha$-$Fe_2O_3$ (haematite) C. I. PR 101:77491, which is preferably used. Orange intermediate hues develop upon a short temperature treatment. They may also be obtained through mixing of yellow and red pigments. The iron oxide pigments with a particle size 2 nm<d<200 nm are preferred.

It is also possible for the first pigment-containing layer to comprise a silicon-oxygen compound, for example amorphous or crystalline silicon dioxide, quartz, a silica gel, or a silicic acid or silicate, i.e. salts or esters of the silicic acids, in particular tetraethylorthosilicate (TEOS), a silicone, or a siloxane.

The pigments and the silicon-oxygen compounds may be applied in a single color layer.

In an alternative embodiment of the invention, the colored bulb coating may have a variable multiple layer construction. It always comprises a first colored layer which comprises a pigment chosen from the group of the perylene pigments, perinone pigments, isoindoline pigments, and thioindigo pigments.

Below the first colored layer, a layer comprising an iron oxide may first be provided on the lamp bulb. The layer comprising an iron oxide may contain the iron oxide either as a fine-grain pigment or as a deposit from a sol-gel process. If the iron oxide is provided as a pigment, both a dry, for example electrostatic, deposition and a wet deposition, for example as a watery suspension by means of dipping or spraying, are possible.

In another embodiment of the invention, the multiple layer construction for the coating of the lamp bulb is such that first a layer comprising an iron oxide is provided on the inside or outside of the lamp bulb. The iron oxide for this layer may either be provided as a fine-grain pigment or in a sol-gel process. A temperature-resistant, transparent protective layer comprising a silicon-oxygen compound, for example a layer of $SiO_2$ or of quartz glass, is provided over the layer comprising iron oxide. The pigment-containing layer is then provided over this assembly.

In a further embodiment of the invention, the multiple layer construction for the coating of the lamp bulb is such that a transparent layer comprising a silicon-oxygen compound is arranged between the bulb and the first pigment-containing layer.

A temperature-resistant, transparent covering layer may be arranged over the pigment-containing layers. The covering layer comprises a silicon-oxygen compound, for example amorphous or crystalline silicon dioxide, quartz, a silica gel, or a silicic acid or a silicate, i.e. salts or esters of the silicic acids, in particular tetraethylorthosilicate (TEOS). Alternatively, this additional covering layer may also be a temperature-resistant, transparent, colorless or colored varnish or a transparent ceramic layer, for example of $Al_2\mathbf{0}_3$ or enamel. If the layers are provided on the inside of the bulb, the covering layer will prevent a chemical change in the pigments. If the coating is provided on the outside, the covering layer provides a scratch-proof surface which renders further processing of the bulb in lamp manufacture easier.

Preferably, a covering layer with a suitable refractive index is used which reduces the scattering caused by the layers containing pigments.

Conventional methods for coating substrates of complicated shape may be used as methods for applying the coating on the lamp bulbs. These include wet coating methods such as, for example, spraying, dipping, and brushing. Dry coating methods, for example electrostatically supported dusting, are suitable for providing the pigmented coating on the lamp bulb.

The pigments are to be dispersed in water, an organic solvent, or a binder mixture, possibly together with a dispersing agent, a surfactant, and an anti-foaming agent in the case of wet coating methods. Suitable binder mixtures for a luminaire according to the invention are organic or inorganic binders which withstand an operating temperature of 250° C. to 350° C. without decomposition, brittling, or discoloration.

A layer thickness from 0.5 to 2.0 μm may be sufficient for layers which contain pigments and which are free from binders. Layers containing binders in general have a layer thickness of 1 to 50 μm.

The pigment-coated lamps were subjected to an accelerated temperature endurance test in which the lamps were kept permanently at 300° C. The color point showed only a minimal shift within the range laid down by the E.C.E and the S.A.E. for the color specification during a period of 150 h. The color point also remained within the E.C.E. color specification during normal lamp operation for a period of 500 h.

BRIEF DESCRIPTION OF THE DRAWINGS

The drawing Figure is a cross-section detail of the wall of the lamp bulb showing the relative positions of the layers. The Figure is purely diagrammatic and not to scale. Some dimensions are shown in a strongly exaggerated form for the sake of clarity.

In a typical embodiment of the invention as shown in the Figure, the lamp has a bulb with a bulb wall (1) which surrounds the interior (2) of the bulb. The bulb wall (1) is coated with a first layer (3). A second layer (4) is between the bulb wall (1) and the first layer (3). A transparent covering layer (5) is arranged over the first layer (3).

DETAILED DESCRIPTION OF THE PREFERRED EMBODIMENTS

Embodiment 1

Figure 1:
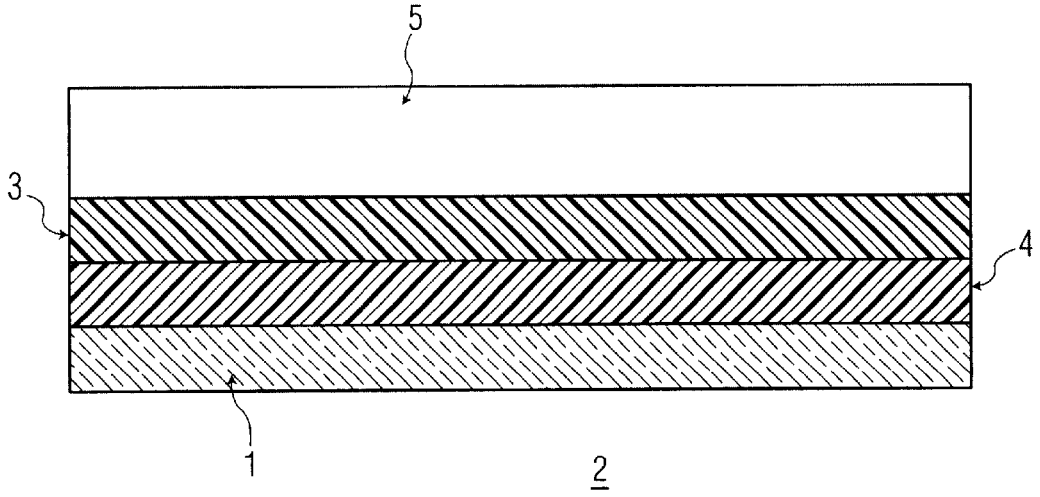

A highly suitable iron oxide pigment is haematite. A coating is obtained, in particular in combination with a mixture, which exhibits a very good color point saturation in the red range and a good light transmission.

To manufacture the bulb coating, first a dispersion of 7.5% by weight of the cis/trans-perinone pigment VR 54 and 7.5% by weight of the transparent iron oxide pigment PR 101, 0.75% by weight of sodium polyacrylate as a dispersing agent, and 0.075% by weight of polyethylenepropylene oxide as an anti-foaming agent are milled in the wet state with water in an agitating mixer until the agglomerated pigment has become dispersed. A surfactant, for example a polyether-modified polysiloxane, may be added to the dispersion. The cleaned and annealed lamp bulbs are dipped in this dispersion and subsequently baked at 250° C.

180 g tetraethylorthosilicate is mixed with 2077 g ethanol, 146 g 1n hydrochloric acid, and 27 ml of an anionic surfactant. The lamp bulbs coated as above are dipped in this mixture and heated at 300° C. for a short time so as to convert the tetraethylorthosilicate into a silicon dioxide layer.

Embodiment 2

A highly suitable iron oxide pigment is haematite. A coating is obtained which shows a very good color point saturation in the red region and a good light transmission in particular in combination with an organic red pigment which is provided as a first layer in a temperature-resistant silicone resin.

To manufacture the lamp coating, first a dispersion of 15% by weight of transparent iron oxide pigment PR 101, 3% by weight of a 25% solution of a sodium salt of a polycarboxylic acid as a dispersing agent, and 0.075% by weight of polyethylenepropylene oxide as an anti-foaming agent are milled in the wet state with water in an agitating mixer until the agglomerated pigment has been dispersed. The dispersion is filtered for the removal of impurities and hard agglomerations. A surfactant, for example a polyether-modified polysiloxane, is added to achieve a better wetting of the lamp bulb. The dispersion is diluted down to a pigment concentration of 8.7% by weight. The cleaned and annealed lamp bulbs are dipped in this dispersion, dried, and subsequently baked at 450° C. A transparent haematite layer of approximately 0.5 μm thickness is obtained.

A further pigment dispersion is obtained through milling of the organic red pigment dimethylperylimide PR 179 in a ball mill. 6% of pigment by weight is for this purpose milled in a solvent mixture of xylol and cyclohexanone (ratio 5:1) with the addition of a dispersing agent until the pigment agglomerates have been dispersed. The dispersing agent used is a pigment-affinated block copolymer in a concentration of 18% by weight in relation to the pigment quantity. The dispersion is filtered and mixed with a silicone resin solution. The silicone resin is a reactive phenyl-methyl silicone which is thermally cross-linked and which is stable at temperatures of up to 500° C. then. The silicone resin solution has a polymer content of 50% by weight in a solvent mixture as used before for milling the pigment. The mixture ready for use contains 32% by weight of silicone and 2.2% by weight of dimethylperylimide pigment PR 179. The lamp bulb already coated with a haematite layer is covered with the solution of silicone resin containing dimethylperylimide pigment by means of spraying. The solvent is evaporated and the silicone resin is cross-linked at 250° C. A red, 8 to 10 μm thick silicone resin layer is obtained as the outer covering layer of the lamp. The dual-layer coating of haematite and dimethylperylimide PR 179 results in a transparent red coating on the lamp which complies with the E.C.E. and S.A.E. standards for red signaling lights.

Embodiment 3

A highly suitable iron oxide pigment is haematite. A coating which has a very good color point saturation in the amber color region and a good light transmission is obtained in particular in combination with an organic yellow pigment which is provided as a first layer in a temperature-resistant silicone resin.

The haematite layer which is to be provided first on the lamp bulb is obtained through milling of the iron oxide pigment PR 101 in water as described with reference to embodiment 2. The milled haematite dispersion is diluted down to 5.5% by weight of pigment content. The lamp bulb is coated by dipping. The dried haematite layer burned-in at 450° C. has a thickness of 0.3 μm. The layer is transparent and reddish brown in color. The color point does not yet comply with the E.C.E standard for amber signaling lights. Accordingly, a further coating with a suitable yellow pigment is necessary for carrying out a color point correction in accordance with the E.C.E. standard.

The isoindoline pigment PY 139 is milled in a solvent mixture to which is added a pigment-affinated block copolymer as a dispersing agent. Milling takes place in accordance with the method indicated for embodiment 2 with dimethylperylimide pigment. The yellow pigment dispersion and the silicone resin solution described for embodiment 2 are mixed in a ratio such that the concentration of isoindoline yellow pigment is 1.6% by weight and of silicone 35% by weight. The lamp bulb already coated with a haematite layer is coated with the silicone resin solution containing the isoindoline pigment by means of spraying. The solvent is evaporated and the silicone resin is cross-linked at 250° C. An approximately 10 to 15 μm thick transparent yellow silicone resin coating is obtained on the haematite-coated lamp, which shifts the color point of the lamp into the E.C.E. standard region for amber signaling lamps.

Embodiment 4

A very suitable mixture of two organic pigments is obtained when an organic red pigment (PR 149, bis-dimethylphenylperylimide) and an organic yellow pigment (PY 139, isoindoline yellow pigment) are used in a silicone resin. A coating is obtained which shows a very good color point saturation in the amber region and a good light transmission.

The yellow isoindoline pigment PY 139 is milled in a solvent mixture to which a pigment-affinated block copolymer is added as a dispersing agent. Milling takes place in accordance with the method indicated in embodiment 2 for the dimethylperylimide pigment. The yellow pigment dispersion and a 50% by weight silicone resin solution, which is a mixture of 80 parts of reactive methylphenyl silicone and 20 parts of reactive polyester-modified methylphenyl silicone, are mixed in a ratio such that the concentration of isoindoline yellow pigment is 2.4% by weight and of the silicone 35% by weight.

The red bis-dimethylphenylperylimide pigment PR 149 is milled in a solvent mixture to which a pigment-affinated block copolymer is added as a dispersing agent. Milling takes place in accordance with the method indicated for embodiment 2 for the dimethylperylimide pigment. The red pigment dispersion and a 50% by weight silicone resin solution, which is a mixture of 80 parts of reactive methylphenyl silicone and 20 parts of reactive polyester-modified methylphenyl silicone, are mixed in a ratio such that the concentration of red bis-dimethylphenylperylimide pigment is 0.8% by weight and of silicone 35% by weight.

The two pigment dispersions are mixed in equal parts and provided on the lamp bulb by spraying. The solvent is evaporated and the silicone resin is cross-linked at 250° C. A transparent, amber-colored silicone resin layer of 10 to 15 μm thickness is obtained which complies with the E.C.E. standard for signaling lamps.

Embodiment 5

A coating is obtained with a very good color point saturation in the red region and a good light transmission when the organic red pigment bis-dimethylphenylperylimide PR 149 is used in a silicone resin.

The red bis-dimethylphenylperylimide pigment PR 149 is milled in a solvent mixture to which a pigment-affinated block copolymer is added as a dispersing agent. Milling takes place by the method indicated in embodiment 2 for the dimethylperylimide pigment. The red pigment dispersion and a 50% by weight silicone resin solution are mixed in a ratio such that the concentration of red bis-dimethylphenylperylimide pigment is 2.9% by weight and of silicone is 33% by weight. The silicone resin is a reactive phenylmethyl silicone which is thermally cross-linked and which is stable up to temperatures of 500° C. then.

The lamp bulb is coated with the silicone resin solution containing red pigment by means of spraying. The solvent is evaporated and the silicone resin is cross-linked at 250° C. An approximately 15 μm thick transparent red silicone resin coating is obtained which has a color point complying with the E.C.E. and S.A.E. standards for red signaling lamps.

Embodiment 6

A particularly hard and scratch-resistant coating is obtained with a very good color point saturation in the red color region and a good light transmission when a layer of the organic red pigment bis-dimethylphenylperylimide PR 149 is covered with a silicon dioxide sol-gel layer.

To manufacture the lamp coating, first a dispersion of 10% by weight of bis-dimethylphenylperylimide PR 149, 10% by weight of a 40% aqueous solution of a pigment-affinated block copolymer as a dispersing agent, and 0.075% by weight of polyethylenepropylene oxide as an anti-foaming agent are milled with water in a ball mill until the agglomerated pigment has become dispersed. The dispersion is filtered for removing impurities and hard agglomerates. A surfactant, for example a polyether-modified polysiloxane, may be added for better wetting of the lamp bulb.

The cleaned and annealed lamp bulbs are dipped in this dispersion, dried, and subsequently baked at 250° C. A transparent pigment layer of approximately 1.5 μm thickness is obtained.

180 g tetraethylorthosilicate is mixed with 2077 g ethanol, 146 g 1n hydrochloric acid, and 27 ml of an anionic surfactant. The previously coated lamp bulbs are dipped in this mixture and heated at 300° C. for a short time so as to convert the tetraethylorthosilicate into a silicon dioxide layer. A scratch-proof, transparent red coating is obtained with a color point which complies with the E.C.E. and S.A.E. standards for red signaling lamps.

Embodiment 7

A coating is obtained with a very good color point saturation in the red region and a good light transmission when a mixture of the highly suitable iron oxide pigment haematite with the organic red pigment dimethylperylimide PR 179 is used.

A pigment dispersion of the organic red pigment dimethylperylimide PR 179 is obtained through milling in a ball mill. 6% by weight of pigment is for this purpose milled in a solvent mixture of xylol and cyclohexanone (ratio 5:1) with the addition of a dispersing agent until the pigment agglomerates have become dispersed. A pigment-affinated block copolymer is used in a concentration of 18% by weight with respect to the pigment quantity for the dispersing agent.

A further pigment dispersion is obtained through milling of iron oxide pigment PR 101. 15% by weight of transparent iron oxide pigment PR 101 and 3.75% by weight of a pigment-affinated block copolymer as a dispersing agent are milled in a 25% by weight solution of a phenylmethyl silicone resin in a ball mill. The solvent is a mixture of xylol and cyclohexanone (ratio 5:1). The silicone resin is a reactive phenylmethyl silicone which is thermally cross-linked and which is stable up to temperatures of 500° C. then.

The pigment dispersions are filtered for removing impurities and hard agglomerates and are mixed with a silicone resin solution. The silicone resin is a reactive phenylmethyl silicone which is thermally cross-linked and which is stable up to temperatures of 500° C. then. The mixture suitable for spray coating comprises 42% by weight of silicone, 2.2% by weight of dimethylperylimide pigment, and 2.8% by weight of iron oxide pigment PR 101.

The lamp bulb is coated with the silicone resin solution containing the red pigment by means of spraying. The solvent is evaporated and the silicone resin is cross-linked at 250° C. An approximately 15 to 20 μm thick transparent red silicone resin coating is obtained which has a color point complying with the E.C.E. and S.A.E. standards for red signaling lamps.

Embodiment 8

A coating with a very good color point saturation in the red region and a good light transmission is obtained when a mixture of the highly suitable transparent iron oxide pigment haematite PR 101 is used in combination with the isoindoline yellow pigment PY 139.

15% by weight of transparent iron oxide pigment PR 101 and 3.75% by weight of a pigment-affinated block copolymer as a dispersing agent are milled in a 25% by weight solution of a phenylmethyl silicone resin in a ball mill. The solvent is a mixture of xylol and cyclohexanone (ratio 5:1). The silicone resin is a reactive phenylmethyl silicone which is thermally cross-linked and which is stable up to temperatures of 500° C. then.

A further pigment dispersion is obtained through milling of a yellow isoindoline pigment PY 139 in a ball mill. 6% by weight of pigment is for this purpose milled in a solvent mixture of xylol and cyclohexanone (ratio 5:1) with the addition of a dispersing agent until the pigment agglomerates have become dispersed. A pigment-affinated block copolymer in a concentration of 18% by weight in relation to the pigment quantity is used as the dispersing agent.

The dispersions are filtered and mixed with a silicone resin solution. The silicone resin is a reactive phenylmethyl silicone which is dissolved in a solvent mixture of xylol and cyclohexanone (ratio 5:1). The mixture suitable for spray coating contains 35% by weight of silicone, 2.8% by weight of iron oxide pigment PR 101, and 1.6% by weight of isoindoline yellow pigment PY 139.

The lamp bulb is coated with the silicone resin solution containing the pigment by means of spraying. The solvent is evaporated and the silicone resin is cross-linked at 250° C. A transparent, amber-colored silicone resin layer of approximately 15 μm thickness is obtained which complies with the E.C.E. standard for signaling lamps.

Embodiment 9

A coating having a very good color point saturation in the amber color region and a good light transmission is obtained when the organic isoindoline yellow pigment PY 185 is used.

The yellow isoindoline pigment PY 185 is milled in a solvent mixture to which a pigment-affinated block copolymer was added as a dispersing agent. Milling takes place by the method indicated in embodiment 2 for the dimethylperylimide pigment. The yellow pigment dispersion and a 50% by weight silicone resin solution are mixed in a ratio such that the concentration of yellow isoindoline pigment is 2.9% by weight and of silicone 33% by weight. The silicone resin is a reactive phenylmethyl silicone which is thermally cross-linked and which is stable up to temperatures of 500° C. then. The lamp bulb is coated with the silicone resin solution containing the yellow pigment by means of spraying. The solvent is evaporated and the silicone resin is cross-linked at 250° C. An approximately 20 μm thick transparent yellow coating is obtained which has a color point which complies with the E.C.E. and S.A.E. standards for amber signaling lamps.

Embodiment 10

A coating is obtained which has a very good color point saturation in the red color region and a good light transmission when the red pigment dichlorodiketopyrrolopyrrole PR 54 is used.

The red pigment dichlorodiketopyrrolopyrrole (PR 254) is milled in a solvent mixture to which a pigment-affinated block copolymer was added as a dispersing agent. Milling takes place by the method as indicated for embodiment 5. The red pigment dispersion and a 50% by weight silicone resin solution are mixed in a ratio such that the concentration of red dichlorodiketopyrrolopyrrole pigment is 2.9% by weight and that of silicone is 33% by weight. The silicone resin is a reactive phenylmethyl silicone which is thermally cross-linked and which is stable up to temperatures of 500° C. then. The lamp bulb is coated with the silicone resin solution containing the red pigment by means of spraying. The solvent is evaporated and the silicone resin is cross-linked at 250° C. An approximately 15 to 20 μm thick transparent red coating is obtained which has a color point which complies with the E.C.E. and S.A.E. standards for red signaling lamps.

Embodiment 11

A coating is obtained which has a very good color point saturation in the red region and a good light transmission when a mixture of the highly suitable iron oxide pigment haematite PR 101 is used together with the organic red pigment tetrachlorothioindigo PR 88.

A pigment dispersion of the organic red pigment tetrachlorothioindigo PR 88 is obtained through milling in a ball mill. 8.5% by weight of pigment is for this purpose milled in a solvent mixture of xylol and cyclohexanone (ratio 5:1) to which a dispersing agent was added, until the pigment agglomerates have become dispersed. A pigment-affinated block copolymer in a concentration of 15% by weight in relation to the pigment quantity is used as the dispersing agent.

A further pigment dispersion is obtained through milling of the iron oxide pigment PR 101. 15% by weight of transparent iron oxide pigment PR 101 and 3.75% by weight of a pigment-affinated block copolymer as a dispersing agent are milled in a 25% by weight solution of a phenylmethyl silicone resin in a ball mill. The solvent is a mixture of xylol and cyclohexanone (ratio 5:1). The silicone resin is a reactive phenylmethyl silicone which is thermally cross-linked and is stable up to temperatures of 500° C. then.

The pigment dispersions are filtered for removing impurities and hard agglomerates and are mixed with a silicone resin solution. The silicone resin is a reactive phenylmethyl silicone which is thermally cross-linked and is stable up to temperatures of 500° C. then. The mixture suitable for spray coating contains 37% by weight of silicone, 3.2% by weight of tetrachlorothioindigo PR 88, and 2.8% by weight of iron oxide pigment PR 101.

The lamp bulb is coated with the silicone resin solution containing the red pigment by means of spraying. The solvent is evaporated and the silicone resin is cross-linked at 250° C. An approximately 15 μm thick transparent red coating is obtained which has a color point which complies with the E.C.E. and S.A.E. standards for red signaling lamps.

What is claimed is:

1. A colored luminaire fitted with a lamp and a luminaire cover wherein the lamp has a bulb with a coating with a first layer comprising a pigment, which pigment is chosen from the group comprising perinone pigments and isoindoline pigments.

2. A colored luminaire as claimed in claim 1, wherein the first layer comprising a pigment in addition comprises an iron oxide pigment.

3. A colored luminaire as claimed in claim 1, wherein the first layer comprising a pigment comprises an iron oxide pigment and a silicon-oxygen compound.

4. A colored luminaire as claimed in claim 1, wherein a second layer comprising a pigment is arranged between the bulb and the first layer comprising a pigment, which second layer comprises an iron oxide pigment.

5. A colored luminaire as claimed in claim 1, wherein a transparent layer comprising a silicon-oxygen compound is arranged between the bulb and the first layer comprising a pigment.

6. A colored luminaire as claimed in claim 1, wherein the lamp comprises a transparent covering layer comprising a silicon-oxygen compound so as to improve the scratch resistance of the coating comprising a pigment.

7. A lamp with a bulb having a coating of a layer comprising a pigment chosen from a group which comprises the perylene pigments, perinone pigments, isoindoline pigments, and thioindigo pigments.

8. A lamp comprising a bulb with a coating with a layer comprising a pigment chosen from the group consisting of perinone pigments or isoindoline pigments.

9. A luminaire comprising a lamp and a colorless luminaire cover wherein the lamp has a bulb with a coating with a first layer comprising a pigment, which pigment is a perylene pigment, perinone pigment, isoindoline pigment or thioindigo pigment, and wherein a second layer comprising an iron oxide pigment is arranged between the bulb and the first layer.

10. A luminaire as claimed in claim 9, wherein a transparent layer comprising a silicon-oxygen compound is arranged between the bulb and the first layer.

11. A luminaire as claimed in claim 9, wherein the lamp comprises a transparent covering layer comprising a silicon-oxygen compound so as to improve the scratch resistance of the coating comprising a pigment.

12. A coating for a lamp emitting colored light comprising:

a first pigment layer comprising a pigment chosen from the group consisting of perylene pigments, perinone pigments, isoindoline pigments, and thioindigo pigments;

a second pigment layer comprising iron oxide;

a protective layer comprising a silicon-oxygen compound; and an additional covering layer comprising temperature-resistant transparent material, the coating being applied to at least part of a bulb of the lamp and said additional covering layer forming the boundaries of said coating.

13. The coating claimed in claim 12, wherein the additional covering layer is on a surface of the first pigment layer;

the protective layer is on a surface of the first pigment layer opposite the additional covering layer;

the second pigment layer is on a surface of the protective layer opposite the first pigment layer; and the second pigment layer is on the bulb, the bulb being on a side of the second pigment layer which is opposite the protective layer, the bulb forming, at least partially, the enclosure of a hermetically sealed interior of the lamp.

14. The coating claimed in claim 13, wherein the second pigment is on a side of the bulb facing the interior of the lamp.

15. The coating claimed in claim 13, wherein the second pigment is on a side of the bulb facing the exterior of the lamp.

16. The coating claimed in claim 12, wherein the additional covering layer is on a surface of the first pigment layer;

the second pigment layer is on a surface of the first pigment layer opposite the additional covering layer;

the protective layer is on a surface of the second pigment layer opposite the first pigment layer; and the protective layer is on the bulb, said bulb being on a surface of the protective layer which is opposite the second pigment layer.

* * * * *